US010501926B2

(12) United States Patent
Priester

(10) Patent No.: US 10,501,926 B2
(45) Date of Patent: Dec. 10, 2019

(54) INLAY TRAY THRESHOLD TRENCH DRAIN

(71) Applicant: Jay R. Smith Mfg. Co., Montgomery, AL (US)

(72) Inventor: Donald E. Priester, Deatsville, AL (US)

(73) Assignee: Smith Industries, Inc., Montgomery, AL (US)

( * ) Notice: Subject to any disclaimer, the term of this patent is extended or adjusted under 35 U.S.C. 154(b) by 0 days.

(21) Appl. No.: 16/042,229

(22) Filed: Jul. 23, 2018

(65) Prior Publication Data

US 2019/0032323 A1 Jan. 31, 2019

Related U.S. Application Data

(60) Provisional application No. 62/537,116, filed on Jul. 26, 2017.

(51) Int. Cl.
*E03F 5/04* (2006.01)
*E03F 5/06* (2006.01)

(52) U.S. Cl.
CPC ..... *E03F 5/0407* (2013.01); *E03F 5/06* (2013.01)

(58) Field of Classification Search
CPC ..... E03F 5/0407; E03F 5/06
USPC ..... 52/302.3
See application file for complete search history.

(56) References Cited

U.S. PATENT DOCUMENTS 2,045,529 A * 6/1936 Kritzer ..... F25D 21/14 62/290
2,095,219 A * 10/1937 Lear ..... F25D 21/14 62/290
3,527,148 A * 9/1970 Schack ..... E03F 5/06 404/25
4,321,713 A * 3/1982 Thompson ..... E03C 1/26 4/286
RE31,561 E * 4/1984 Thompson ..... E03C 1/26 4/286
5,729,996 A * 3/1998 Barger ..... F25D 21/14 62/288
9,458,616 B2 10/2016 Whiteside
10,167,621 B2 * 1/2019 Priester ..... E03F 5/0407
2008/0106094 A1 * 5/2008 Edelmayer ..... E03F 5/0407 285/42
2016/0298324 A1 10/2016 Blamble
(Continued)

FOREIGN PATENT DOCUMENTS

CA 2925260 A1 * 8/2017 ..... B66B 13/301
DE 19622021 A1 * 12/1997 ..... E03F 5/06
EP 2639367 A1 * 9/2013 ..... E03F 5/0407
(Continued)

*Primary Examiner* — Jeanette E Chapman
(74) *Attorney, Agent, or Firm* — Eric J. Sosenko; Jonathan P. O'Brien; Honigman LLP

(57) ABSTRACT

A threshold drain for collecting an incoming flow of water. The threshold drain includes a catch pan having sidewalls, end walls, a bottom wall and an open top. The catch pan having a width defined between the sidewalls, a length defined between the end walls and a depth defined between the bottom wall and the open top. A grate received within the catch pan and extending between the pan sidewalls. The grate includes a louver array portion and an inlay tray portion. The louver array is configured to permit water to pass into the drain. The inlay tray portion is configured to receive a flooring material.

17 Claims, 4 Drawing Sheets

(56) References Cited

U.S. PATENT DOCUMENTS

2018/0087260 A1* 3/2018 Priester ..... E03F 5/0407

FOREIGN PATENT DOCUMENTS

| | | | | |
|---|---|---|---|---|
| EP | 2905388 | | 8/2015 | |
| EP | 2902556 | B1 * | 1/2018 | ..... E03F 5/06 |
| JP | H09189068 | | 7/1997 | |
| JP | H09279670 | | 10/1997 | |
| JP | 2002227111 | | 8/2002 | |
| JP | 2005139826 | | 6/2005 | |
| JP | 2008320767 | | 11/2005 | |
| JP | 2006125185 | | 5/2006 | |
| JP | 2007040004 | | 2/2007 | |
| JP | 20100090700 | | 4/2010 | |
| JP | 3161730 | | 8/2010 | |
| JP | 2014240566 | | 12/2014 | |
| WO | WO-0235141 | A1 * | 5/2002 | ..... E03F 5/06 |
| WO | 2006011814 | | 2/2006 | |
| WO | WO-2010083568 | A2 * | 7/2010 | ..... E03F 5/06 |

* cited by examiner

INLAY TRAY THRESHOLD TRENCH DRAIN

CROSS REFERENCE TO RELATED APPLICATION

This application is a non-provisional patent application claiming priority to U.S. Application No. 62/537,116 filed Jul. 26, 2017, which is hereby incorporated by reference in its entirety.

BACKGROUND

1. Field of the Invention

The present invention generally relates to a threshold trench drain and drainage system as might be used with a door, stairwell or elevator threshold, and more particularly to such a drain that also aesthetically enhances the area in which the drain is installed.

2. Description of Related Art

At their installation site, thresholds provide a transition between different environments or spaces. For example, a threshold may provide a transition from an interior space to an exterior space, such as at a door of a building. Additionally, the threshold may be provided at a transition from one interior space to another interior space, such as from an interior hallway into the stairwell of a building or from an elevator lobby into the elevator. A threshold may also provide a transition from one exterior space to another exterior space, such as from an uncovered to a covered outdoor space.

Most all public accommodations are now required to incorporate fire suppression systems into their construction. During a fire suppression event, a large amount of water is discharged by the fire suppression system into the space where the event was detected. While the discharging of water by the fire suppression system may only occur in the area of the building where the triggering event was sensed, once discharged, the associated large volume of water is not confined to the area of the triggering event. Rather, discharged water often flows across thresholds and into adjacent spaces of the building. For example, water discharged on one floor may cross a stairway door threshold and flow into and down the stairwell, and possibly into other floors located below. In another example, water discharged on the floor may flow across an elevator threshold and into the elevator shaft.

As previously noted, the fire suppression event generates a large flow water. The flow of water across a threshold may be as much as 100 gallons per minute (GPM). As a result, a large amount of unnecessary property damage can be caused by water flowing into a space not directly associated with the event triggering the fire suppression system.

In view of the above, it is apparent that it would be preferable to constrain the flow of water during a fire suppression event across a threshold and prevent the flow of water from entering into an adjacent space, not subject to the triggering event, thereby minimizing or preventing damage to adjacent spaces.

While such achieving the above, it would also be preferable that the device containing and preventing the flow of water across the threshold be aesthetically pleasing and unobtrusive since, for the majority of time and perhaps its entire lifetime, no such flow of water may occur.

SUMMARY

In satisfying the above need, as well as overcoming the enumerated drawbacks and other limitations of the related art, the present invention provides an aesthetically pleasing threshold trench drain for constraining and preventing an incoming water flow from crossing a threshold at the installation site.

In one aspect of the invention, a threshold trench drain provided. The threshold trench drain includes a catch pan having pan sidewalls, pan end walls, a pan bottom wall and a pan open top. The width of the catch pan is defined between the pan sidewalls, the length is defined between the pan end walls and a depth defined between the pan bottom wall and the pan open top. The pan bottom wall includes portions defining a pan outlet. Coupled to the pan outlet and extending away from the catch pan is a pipe flange. The flange pipe defines a central axis and is configured to couple the threshold drain to the drainage system. A grate is received within the catch pan and includes transverse webs and longitudinal webs with spaces defined there between. The transverse webs extend parallel to one another over part of the width of the catch pan and are spaced above the pan bottom wall. The longitudinal webs extend parallel to one another along the length of the catch pan and are also supported above the pan bottom wall. The orientation of the longitudinal webs is inclined toward the side of the threshold drain where the incoming flow of water is expected. The remaining width and length of the grate defines an inlay tray configured for the inlaying of tiles. The tray includes a bottom wall spaced above the pan bottom wall and below the pan open top, and the tiles may be ceramic, carpet or other types of tile, preferably coordinated with the flooring of the adjacent space.

DETAILED DESCRIPTION

As used in the description that follows, directional terms such as "upper" and "lower" are used with reference to the orientation of the elements as presented in an installed state and as shown in the figures. Accordingly, "upper" indicates a direction toward the top of the figure and "lower" indicates a direction toward the bottom of the figure. The terms "left" and "right" are similarly interpreted relative to the figures. The terms "inward" or "inner" and "outward" or "outer" indicate a direction that is generally toward or away from a central axis of the referred to part, whether or not such an axis is designated in the figures. It will be understood, however, that in actual implementation, the directional references used herein may not necessarily correspond identically with the installation and orientation of the corresponding components or device.

Figure 1:
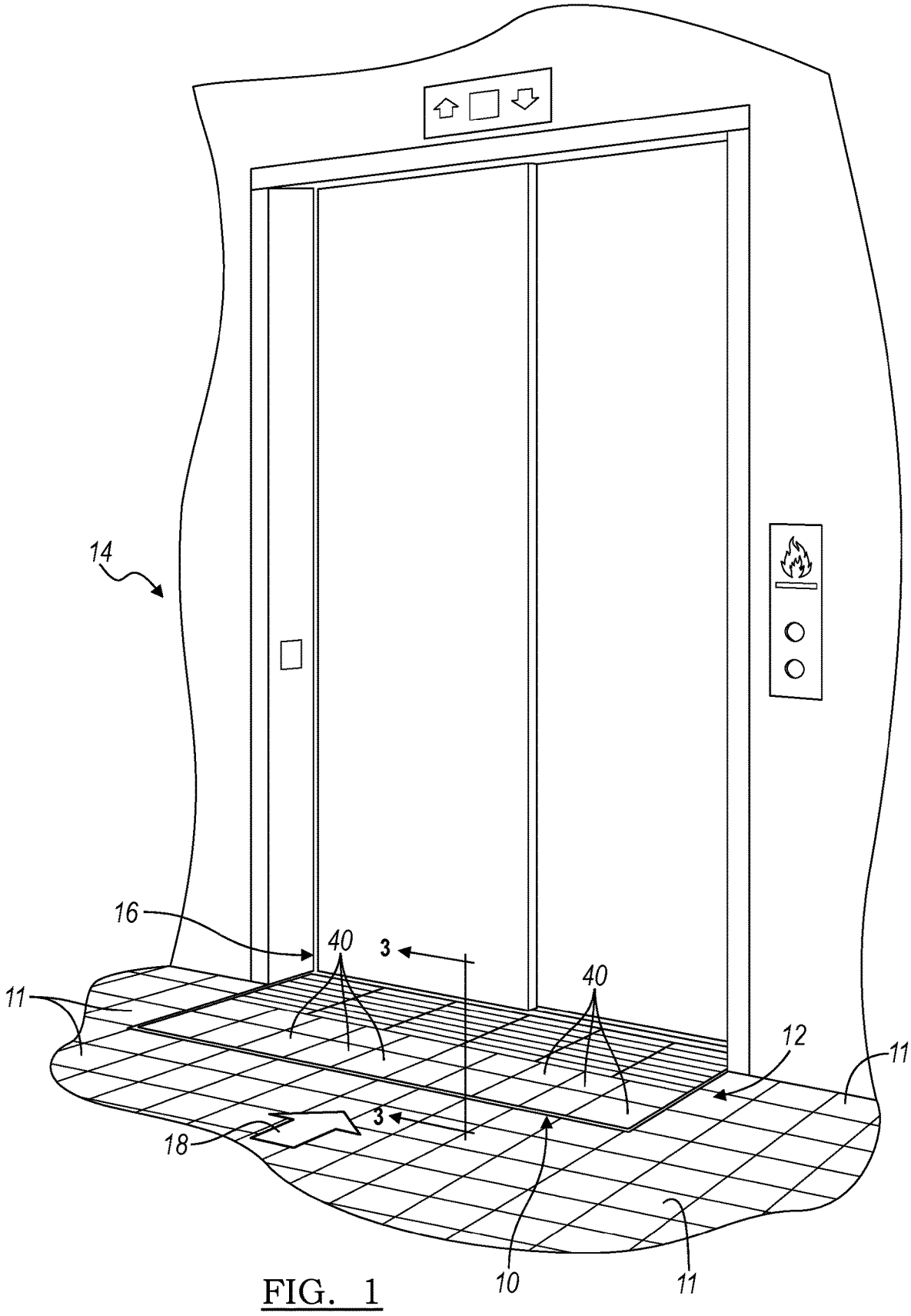
FIG. 1 is a perspective view of an elevator lobby incorporating an inlay tray threshold trench drain embodying the principles of the present invention.

Referring now to the drawings, a threshold trench drain (hereafter "drain") embodying the principles of the present invention is generally illustrated in FIG. 1 and designated at 10. As shown therein, the drain 10 is installed in a threshold 12 that defines the transition between an elevator lobby 14 and an elevator or elevator shaft 16. During a fire suppression event in the elevator lobby 14, a large volume of water will be discharged into the elevator lobby 14. Invariably, this large volume of water will establish an inflow direction 18 from the elevator lobby 14 across the elevator threshold 12 and into the elevator shaft 16, potentially damaging additional aspects of the building.

While the present invention is being specifically illustrated and described in connection with a threshold 12 between an elevator lobby 14 and an elevator/elevator shaft 16, it will be readily appreciated that the principles of the present invention are equally applicable to any threshold between two adjacent areas where it is desirable to prevent the flow of water between the adjacent areas. Accordingly, the present invention is not intended to be limited to any one specific type of installation.

Figure 2:
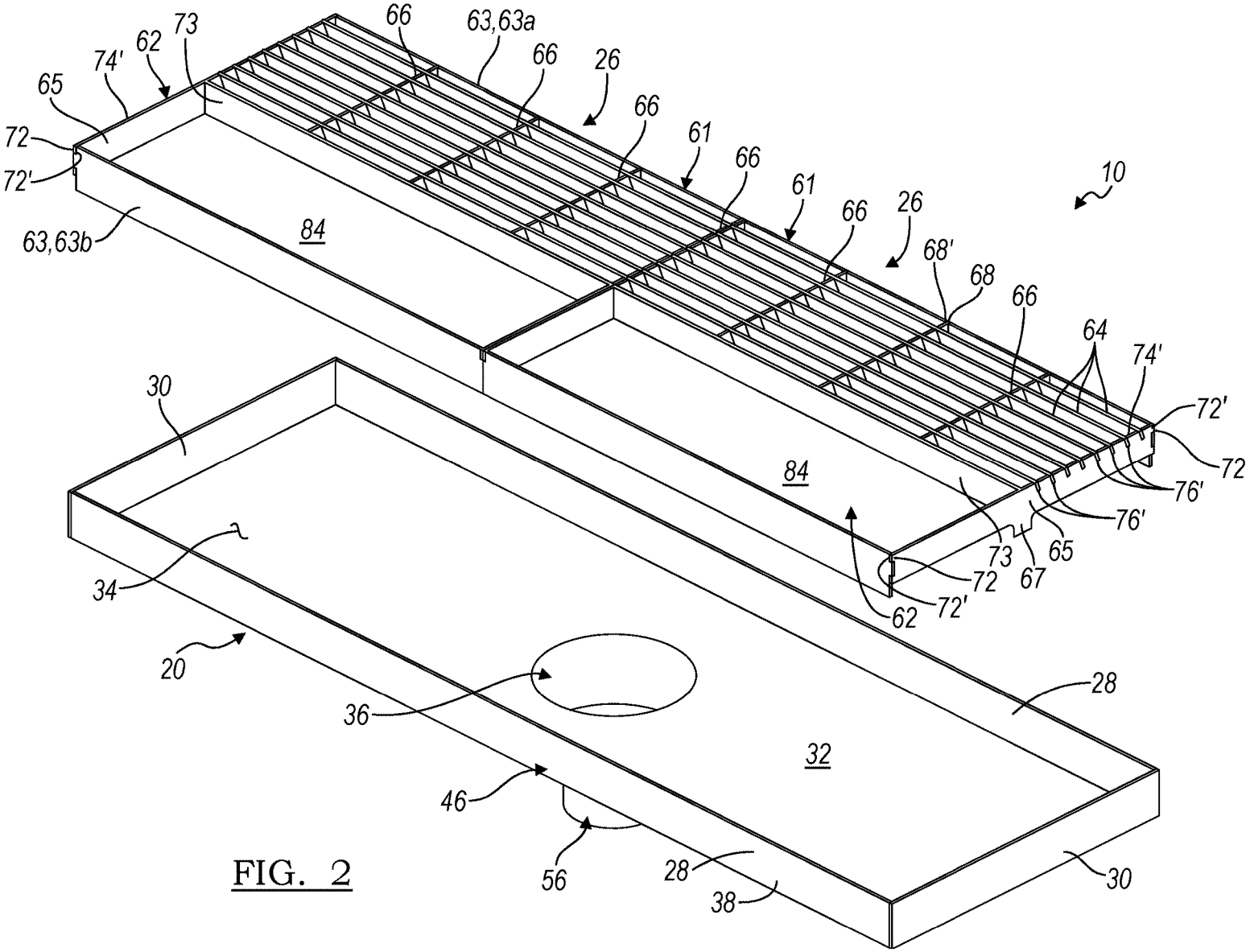
FIG. 2 is a exploded perspective view of an inlay tray threshold trench drain embodying the principles of the present invention.

Referring now to FIG. 2, the drain 10 is illustrated in an exploded view and is seen as having as its principal components a catch pan 20, a sump 46, a pipe flange 56, and multiple grates 26, although a single grate 26 of the appropriate length could alternately be employed.

The catch pan 20 has a generally rectangular configuration and includes opposing parallel pan sidewalls 28 between which extend opposing parallel pan end walls 30. While illustrated with a rectangular configuration, it will be really appreciated that, depending on the requirements of the particular installation, the configuration of the catch pan 20, and at least the grate 26, can be other than rectangular.

While other materials and sizes may be utilized, the catch pan 20 is preferably constructed from 14 gauge stainless steel sheet (0.0781 inch nominal thickness), has an overall length of about 42 inches and a width of about 13 9/16 inches, thereby providing the catch pan 20 with a length to width ratio of 3.1:1 or about 3:1.

The catch pan 20 also includes a pan bottom wall 32 and a pan open top 34. The pan bottom wall 32 extends between the pan sidewalls 28 and the pan end walls 30 and, as the name implies, defines the bottom wall of the catch pan 20. Portions of the pan bottom wall 32 define a pan outlet 36, which is illustrated as being round and centrally located in the pan bottom wall 32. The pan outlet 36, however, may be provided other than centrally and other than in a round configuration, depending on the particular requirements of the installation.

Optionally, each of the pan sidewalls 28 may be formed with an inwardly extending step or shoulder that defines a support surface (not shown). The shoulders and support surfaces may be provided approximately halfway, less than halfway or more than halfway down the height of the pan sidewalls 28 and would be utilized to support the grate 26 above the upper surface of the pan bottom wall 32. In the discussion that follows, the grate is provided with other features to space portions of the grate 26 above the pan bottom wall 32.

It is additionally noted that the pan sidewalls 28 have a height that renders the catch pan 20, as well as the drain 10, with a shallow depth. Preferably, the shallow depth is the height of the pan sidewalls 28, as measured from the lower surface 42 of the pan bottom wall 32 to the top surface 44 of the pan sidewalls 28, of about 2 inches and more preferably less, about 1.75 inches. Providing the pan sidewalls 28 and the drain 10 with such a shallow height allows the drain 10 to be installed on a subfloor of the installation site and allows the finished floor of the installation site to be build up so as to be flush with the top of the drain 10. Deeper drains, those with pan sidewalls 28 greater than that mention above, would require that the subfloor of the installation site be modified to accommodate and accept such a drain. Alone, the shallow catch pan 20 reduces the capacity of water (gallons per minute or GPM) that can be accommodated by the drain 10.

Mounted to the pan bottom wall 32 about the pan outlet 36 is a sump 46. The sump 46 generally includes a round cylindrical sump sidewall 48 extending downward from the bottom surface 42 of the pan bottom wall 32. A sump bottom wall 50 closes off the lower portion of the sump sidewall 46 and further includes portions defining a sump outlet 52 extending through the sump bottom wall 48. The upper extent of the sump 46 is defined by a sump open top 54, which is generally coincident with the pan outlet 36.

Connected to the sump bottom wall 50, generally about the sump outlet 52, is a pipe flange 56. The pipe flange 56 is defined by a round cylindrical flange sidewall 58, extending generally perpendicularly away from the pan bottom wall 32. When installed, the pipe flange 56 couples the catch pan 20 and the drain 10 to the drain system (not shown) of the installation site. Preferably, the drain 10 includes no restriction upstream of the pipe flange 56 that is less than that of the pipe flange 56 itself. Since the pipe flange 56 extends perpendicularly away from the pan bottom wall 32, the pipe flanged 56 operates to define a reference axis 60 that is generally vertically oriented in the installed position.

Each grate 26 is rectangular in shape and sized to be received within the catch pan 20. As seen in FIG. 2, two grates 26 are received in the catch pan 20 with each grate 26 extending approximately the width of the catch pan 20 and one-half of the length of the catch pan 20. The grates 26 generally include a louver array 61 in conjunction with an inlay tray 62. The louvered array 61 and the inlay tray 62 each occupy about one-half of the width of the grate 26 and each extends substantially the full length of the grate 26. If desired, the louvered array 61 and inlay tray 62 may occupy less than or more than one-half of the width of the grate 26 and may extend less than substantially the full length of the grate 26.

Two side rails 63 define the lateral extent of the grate 26 and are received on the upper surface of the pan bottom wall 32. The opposing ends of the side rails 63 are connected to one another by end rails 65 that define the longitudinal extent of the grate 26. As illustrated, the end rails 64 include tabs 72 that are supported in notches 72' defined in the upper ends of the side rails 63. The end rails 64 each further include a downwardly extending leg 67, about midway between the side rails 33, which is received on the upper surface of the pan bottom wall 32 to support the end rails 65.

Figure 4:
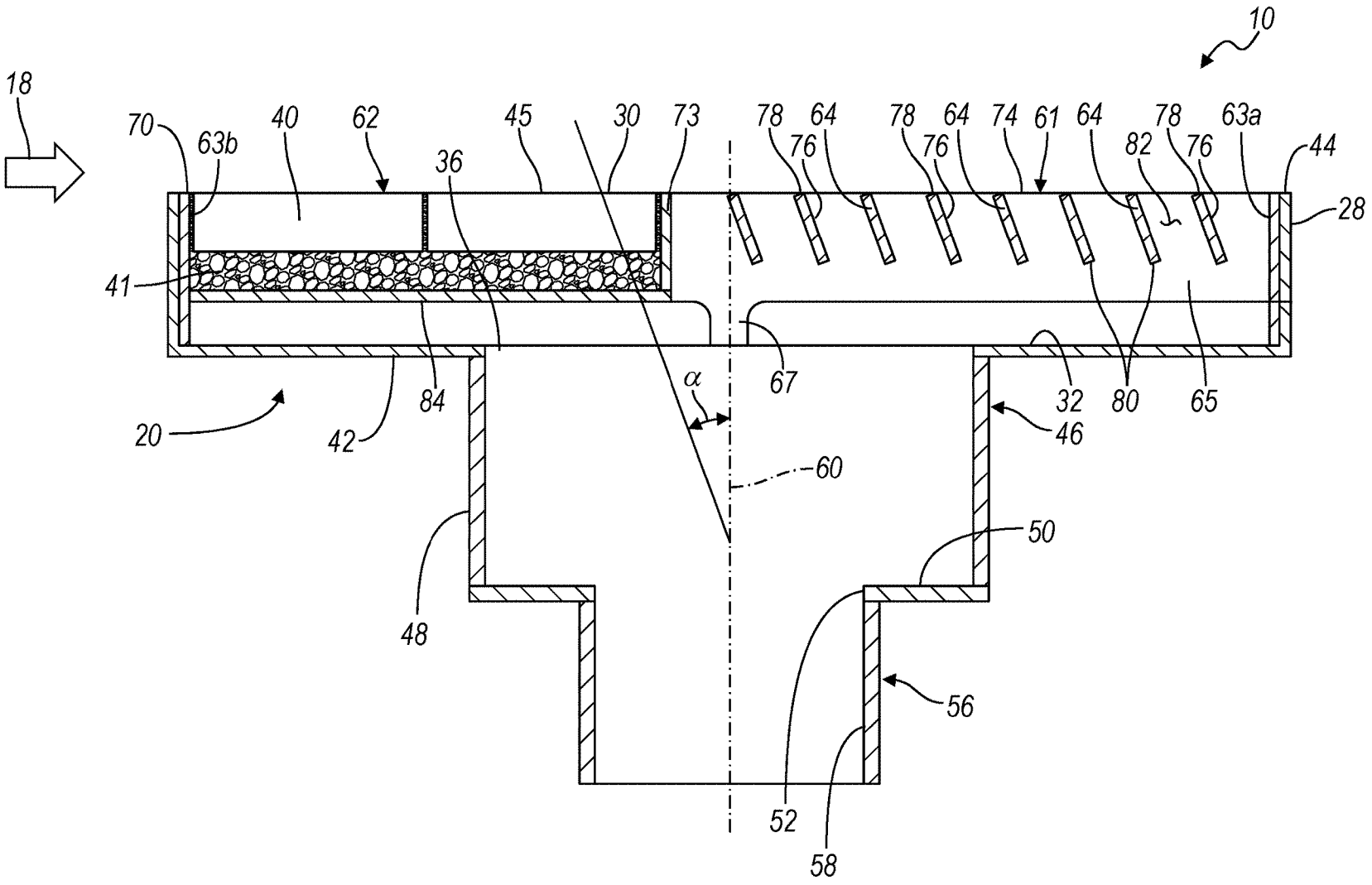
FIG. 4 is an end cross-sectional view of the inlay tray threshold trench drain embodying the principles of the present invention.

Provided between the side rails 63 and the end rails 65 are a series of longitudinal webs 64 and transverse webs 66, which generally define the louver array 61. The longitudinal webs 64 and transverse webs 66 are supported so as to be spaced above the pan bottom wall 32, as seen in FIG. 4.

Referring now to FIG. 2, one of the side rails 63, side rail **63*a* on the louver array side of the grate 26, is formed with a series of notches 68 along its upper edge 70. Corresponding tabs 68' formed on the ends of the transverse webs 66 are received within the notches 68 and allow for the side rail 63*a* to support the transverse webs 66. Preferably, the engagement between the notches 68 and tabs 68' is such that the transverse webs 66** are permanently attached to the side rail 63*a*. Accordingly, this engagement may be a welded engagement or similarly fixed engagement.

To support the other ends of the transverse webs 66, an intermediate rail 73 extends longitudinally between the end rails 65. The intermediate rail 73 defines the inboard or inner extend of both the louver array 61 and inlay tray 62 and is permanently attached to the ends of transverse webs 66 by a welded engagement or similarly fixed engagement.

Each of the transverse webs 66 includes along its upper edge 74 a series of spaced angled notches 76, preferably equidistantly spaced. This is readily seen in FIGS. 3 and 4. Relative to a vertical or reference axis 60, the angled notches 76 are formed at an angle (a) of about 5° to 20°, with about 20° being more preferred. In all instances, however the angle is greater than 0° and less than 90°. The angled notches 76 are correspondingly shaped to the cross-section of the longitudinal webs 64 so that each of the longitudinal webs 64 may be received in a series angled notches 76 defined in adjacent transverse webs 66. Accordingly, each longitudinal web 64 extends across a plurality of transverse webs 66 and is received in one angled notch 76 of each transverse web 66. The engagement between the longitudinal webs 64 and the transverse webs 66 at the angled notches 76 is preferably a permanent engagement, such as by welding or a similarly fixed engagement.

Figure 3:
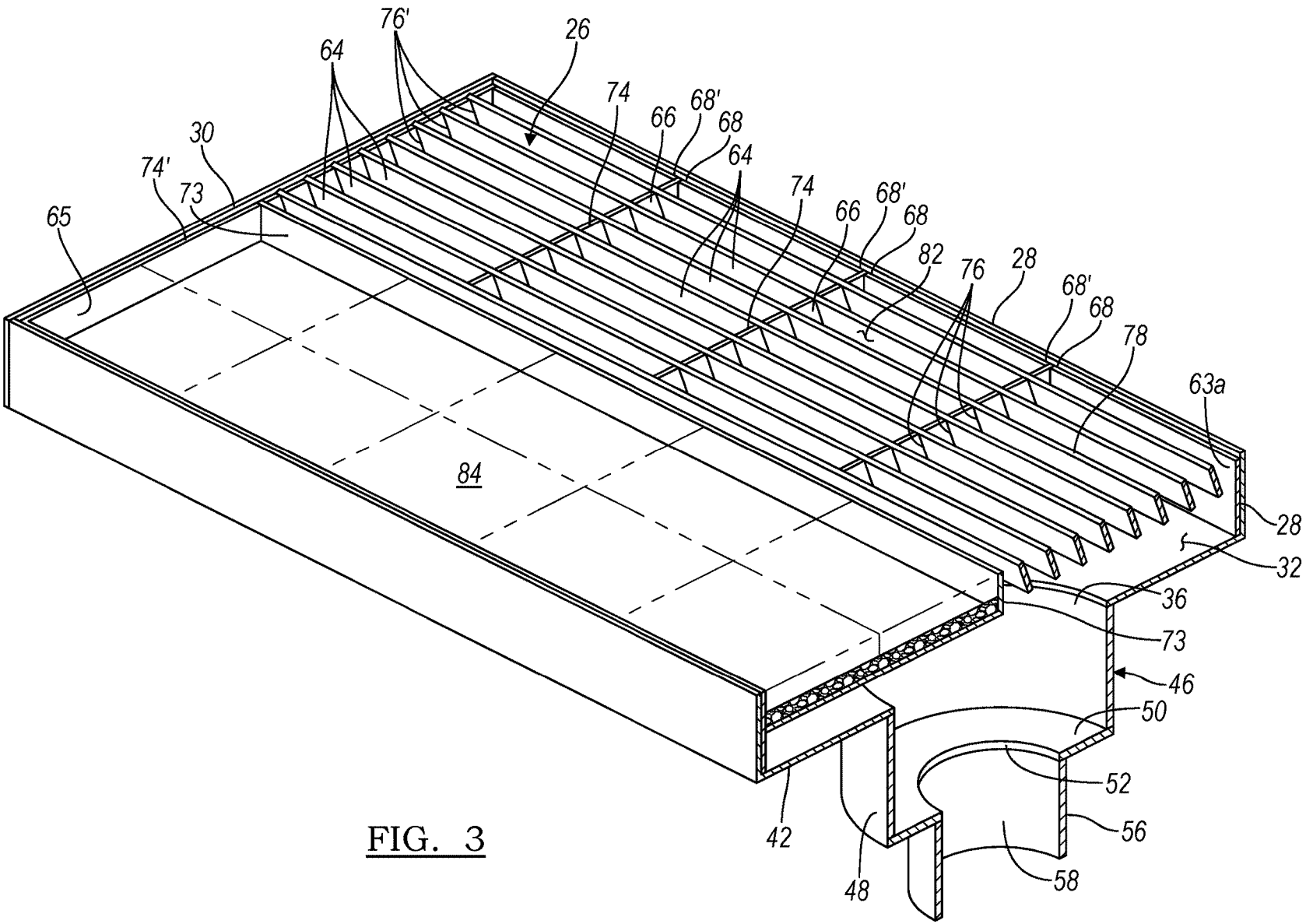
FIG. 3 is a cross-section view along line 3-3 of FIG. 1 of a inlay tray threshold trench drain embodying the principles of the present invention.

Referring now to FIGS. 2 and 3, the end rails 65 have a similar, but slightly different construction than the transverse webs 66 due to the fact that they define the longitudinal ends of the grate 26. In this regard, the end rails 65 include notches 76', corresponding to notches 76, along an upper edge 74' thereof. The notches 76', however, are provided only part way along the length of the end rails 65. The remaining portion of the upper edge 74' of the end rails 65 includes no notches since it is associated with the inlay tray 62. Each end of the longitudinal webs 64 includes an end tab that is received in an angled notch 76' of each end rail 65. The engagement between the longitudinal webs 64 and the end rails 65 at the angled notches 76' is also preferably a permanent engagement, such as by welding or a similarly fixed engagement.

When the longitudinal webs 64 are engaged with the transverse webs 66 and end rails 65, it is preferred that the uppermost portion 78 of each longitudinal web 64 is polished or ground so that the longitudinal webs 64 are provided with a top edge or surface that is flush with upper edge or surface of the transverse webs 66 and the end rails 65.

As previously noted, the transverse webs 66 are equally spaced from one another in the grate 26. Additionally, the longitudinal webs 64 are parallel to one another, spaced approximately ½ to ¼ inches apart, and all angled in a common direction, namely with their upper ends being toward the associated inlay tray 62. Notably, the inlay tray 62 is located on the expected inflow side of the drain 10, which is oriented toward the elevator lobby 14 in FIG. 1.

In the construction as so far described herein, the inlay tray 62 is defined on one lateral side by one of the side rails 63, namely side rail 63*b*, and on the opposing side by intermediate rail 73. The ends of the inlay tray 62 are defined by those remaining portions of the end rails 65 that do not include notches along their upper edges 74'. The inlay tray 62 is defined on its bottom by a tray bottom wall 84 and is open on its upper extent. To secure the tray bottom wall 84, tabs (not shown) are preferably formed about its perimeter at regularly spaced intervals. The tabs are received within corresponding notches (also not shown) formed centrally in the side rail 63*b*, along a bottom edge of the intermediate rail 73, and the bottom edge of those remaining portions of the end rails 65. As with prior engagements, this engagement is preferably a permanent engagement, such as by welding or a similarly fixed engagement.

As seen in FIGS. 1 and 4 and shown in phantom in FIG. 3, the inlay tray 62 is configured to receive a plurality of tiles 40, such as hard-bodied tiles (e.g. ceramic tile) or soft-bodied tiles (e.g. carpet tiles). The tiles 40 may be secured to the tray bottom wall 84 by a thin set mortar or adhesive 41, the latter of which may or may not be integrally provided with the tile 40. Preferably, the top surface 45 of the tile 40 is flush with and aesthetically corresponds to the adjacent surface of the tile or carpet 11 in the elevator lobby 14.

The angular orientation of the transverse webs 66 provides an unexpected advantage to the drain 10 when used in conjunction with the shallowness of the catch pan 20. The angular orientation of the longitudinal webs 64 operates to disrupt the surface tension of the inflow 18 as it passes across the top of the drain 10. The disruption of the surface tension of the inflow 18 allows a greater amount of the inflow 18 to be drawn into the drain 10, through the spaces 82 between adjacent longitudinal webs 64, and to not pass over the top of the grate 26. Absent this angular orientation of the longitudinal webs 64, such as if the longitudinal webs of a grate were provided with a vertical orientation or 0° orientation, the flow rate of water reaching the drain during a fire suppression event would exhibit a surface tension that would allow a substantial portion of the water to flow across and over the drain, and therefore across the threshold and into the adjacent space of the building or installation site, potentially causing additional water damage. With a drain 10 constructed according to the principles of the present invention, the surface tension of the inflow 18 is disrupted and a shallow threshold trench drain 10 with a high-capacity, up to 100 GPM, is provided.

As a person skilled in the art will really appreciate, the above description is meant as an illustration of at least one implementation of the principles of the present invention. This description is not intended to limit the scope or application of this invention since the invention is susceptible to modification, variation and change without departing from the spirit of this invention, as defined in the following claims.

I claim:

1. A threshold drain for collecting an incoming flow of water from a predetermined direction across a threshold at an installation site, the threshold drain comprising:

a catch pan having pan sidewalls, pan end walls, a pan bottom wall and a pan open top, the catch pan having a width defined between the pan sidewalls, a length defined between the pan end walls and a depth defined between the pan bottom wall and the pan open top, the pan bottom wall including portions defining a pan outlet;

a flange pipe coupled to the pan outlet and extending away from the catch pan, the flange pipe being configured to couple the threshold drain to the drain system; and a grate received within the catch pan and extending between the pan sidewalls, the grate including a louver array portion configured to permit water to pass therethrough, the grate also including an inlay tray portion configured to receive a flooring material therein, the louver array portion and the inlay tray portion being located laterally adjacent to one another and cooperating to define a top surface of the threshold drain.

2. The threshold drain according to claim 1, wherein the louver array portion and inlay tray portion extend adjacent to one another along the length of the catch pan.

3. The threshold drain according to claim 1, wherein the louver array portion includes transverse webs and longitudinal webs, the transverse webs extending parallel to one another along the width of the catch pan and having a lower surface spaced above the pan bottom wall, the longitudinal webs extending parallel to one another along the length of the catch pan and being supported by the transverse webs above the pan bottom wall in a fixed orientation, the louver array portion defining an upper surface of the grate.

4. The threshold drain according to claim 1, wherein the inlay tray portion includes a tray bottom wall spaced below the upper surface of the grate.

5. The threshold drain according to claim 4, wherein the flooring material is hard-bodied tile.

6. The threshold drain according to claim 4, wherein the flooring material is soft-bodied tile.

7. A threshold drain for collecting an incoming flow of water from a predetermined direction across a threshold at an installation site, the threshold drain comprising:

a catch pan having pan sidewalls, pan end walls, a pan bottom wall and a pan open top, a width defined between the pan sidewalls, a length defined between the pan end walls and a depth defined between the pan bottom wall and the pan open top, the pan bottom wall including portions defining a pan outlet; and at least one grate received within the catch pan and extending between the pan sidewalls, the grate including a louver array portion and an inlay tray portion, the louver array portion being configured to permit water to pass therethrough, the inlay tray portion configured to receive a flooring material therein, the louver array portion and the inlay tray portion being located laterally adjacent to one another and cooperating to define a top surface of the threshold drain.

8. The threshold drain according to claim 7, wherein the louver array portion and inlay tray portion extend adjacent to one another along the length of the catch pan.

9. The threshold drain according to claim 7, wherein the louver array portion includes a plurality of transverse webs supporting and a plurality of longitudinal webs.

10. The threshold drain according to claim 7, wherein the louver array portion includes a plurality of transverse webs and a plurality of longitudinal webs, the transverse webs extending widthwise of the catch pan and the longitudinal webs extending lengthwise of the catch pan.

11. The threshold drain according to claim 10, wherein the transverse webs and the longitudinal webs have lower surfaces spaced above the pan bottom wall.

12. The threshold drain according to claim 10, wherein the longitudinal webs are angled relative to the pan side walls.

13. The threshold drain according to claim 12, wherein upper ends of the longitudinal webs are located toward the inlay tray portion.

14. The threshold drain according to claim 7, wherein the inlay tray includes a tray bottom wall spaced below the upper surface of the grate.

15. The threshold drain according to claim 7, further comprising flooring material received within the inlay tray portion.

16. The threshold drain according to claim 15, wherein the flooring material is hard-bodied tile.

17. The threshold drain according to claim 15, wherein the flooring material is soft-bodied tile.

* * * * *